United States Patent [19]

Kobayashi et al.

[11] Patent Number: 4,864,194

[45] Date of Patent: Sep. 5, 1989

[54] ELECTRODELESS DISCHARGE LAMP DEVICE

[75] Inventors: Koichi Kobayashi; Masaki Shinomiya; Tsutomu Kobayashi; Masahiro Higashikawa; Shin Ukegawa, all of Kadoma, Japan

[73] Assignee: Matsushita Electric Works, Ltd., Osaka, Japan

[21] Appl. No.: 190,079

[22] Filed: May 4, 1988

[30] Foreign Application Priority Data

May 25, 1987 [JP] Japan ..... 62-127601
May 25, 1987 [JP] Japan ..... 62-127602

[51] Int. Cl.[4] ..... H05B 41/232

[52] U.S. Cl. ..... 315/248; 313/488; 313/609

[58] Field of Search ..... 315/248, 111.01, 111.21, 315/111.31, 111.41, 111.51, 111.61, 111.71, 111.81, 111.91; 313/256, 257, 240, 488, 606, 609

[56] References Cited

U.S. PATENT DOCUMENTS

| | | | |
|---|---|---|---|
| 3,500,118 | 3/1970 | Anderson | 315/57 |
| 4,032,862 | 6/1977 | Huchital et al. | 315/248 |
| 4,704,562 | 11/1987 | Postma et al. | 315/248 |
| 4,710,678 | 12/1987 | Harkes et al. | 315/248 |
| 4,727,294 | 2/1988 | Houkes et al. | 315/248 |

*Primary Examiner*—Donald J. Yusko
*Assistant Examiner*—Brian Palladino
*Attorney, Agent, or Firm*—Burns, Doane, Swecker & Mathis

[57] ABSTRACT

An electrodeless discharge lamp device has an envelope in which a gas that discharges to emit light upon application of a high frequency voltage is sealed, the envelope including two straight pipe parts forming a circulating discharge path, so that a high frequency electric current is caused to flow throughout the discharging gas in the entire envelope and a uniform discharge light emission can be attained.

18 Claims, 5 Drawing Sheets

Fig. 1
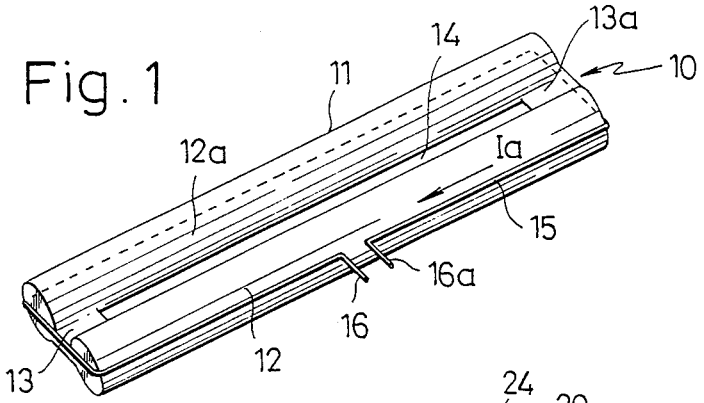
Fig. 2
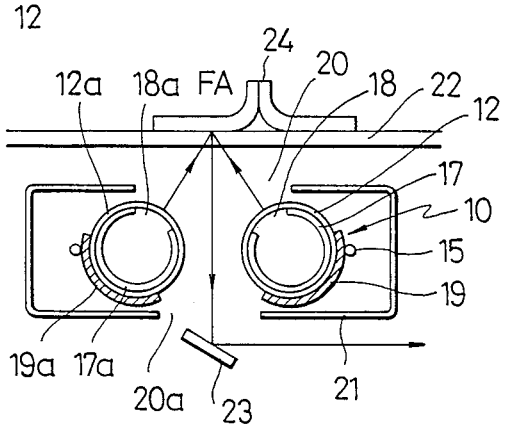
Fig. 3
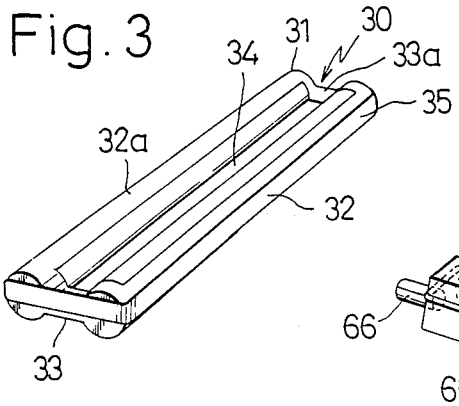
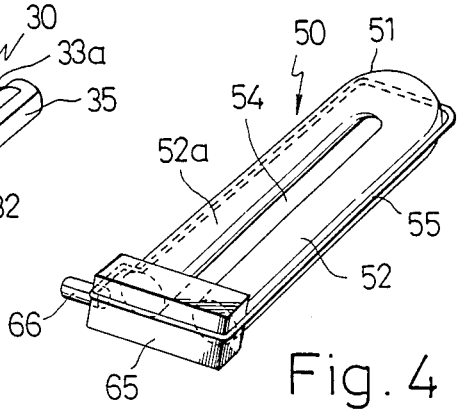
Fig. 4

Fig.10
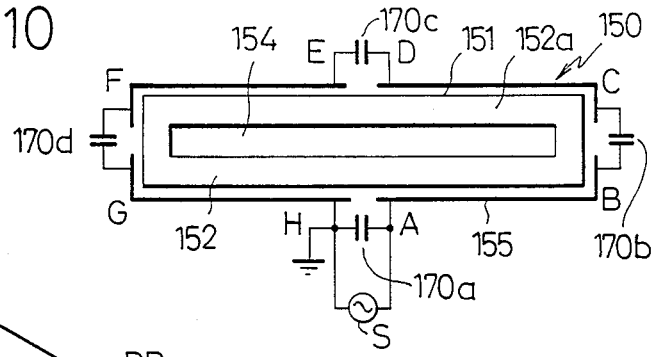
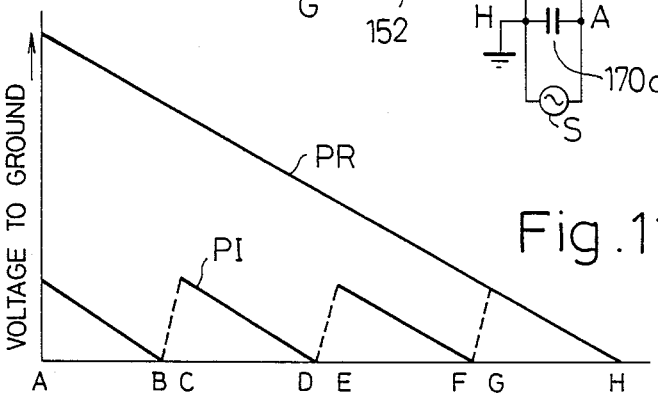
Fig.11
Fig.12
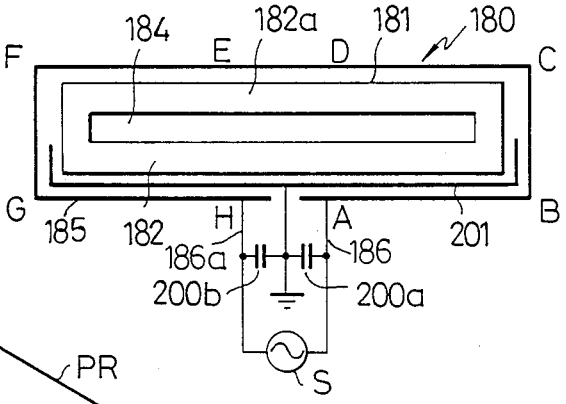
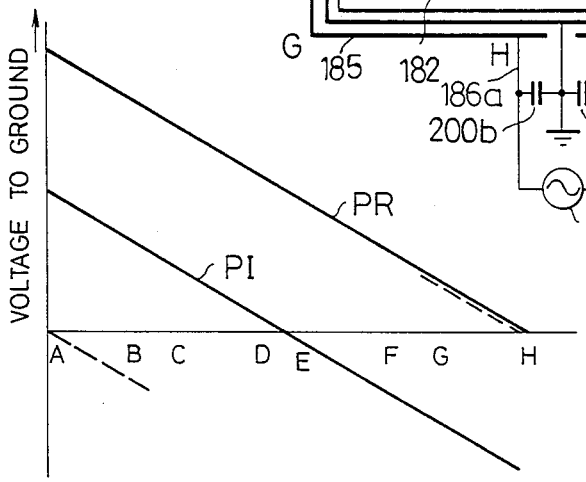
Fig.13

ELECTRODELESS DISCHARGE LAMP DEVICE

TECHNICAL BACKGROUND OF THE INVENTION:

This invention relates to electrodeless discharge lamp devices and, more particularly, to lamp devices having a light transmissive envelope in which such a gaseous member as a rare gas, metal vapor or the like is sealed, and a coil provided to surround outer periphery of the envelope for applying thereto a high frequency voltage and causing the gaseous member inside the envelope to discharge, without electrodes, emitted light by the discharging being converted into visible light by fluorescent coating on inner surface of the envelope.

The particular electrodeless discharge lamp devices are small in size but still high in the output and durability and can be effectively utilized in such optical machines and equipments as electronic copying machines, facsimile devices and so on.

DISCLOSURE OF PRIOR ART:

Generally, as a light source for reading original document in such optical machines as the electronic copying machines, there has been employed a halogen lamp or a discharge lamp device of an ultrahigh output straight tube type. In practice, however, the halogen lamp has been defective in that, while it provides a large quantity of light, this lamp is low in the durability, vibration proofness and luminous efficiency so as to be remarkable in heat generation, so that the optical machine has had to be equipped with a forcible cooling fan or a thermal filter to render manufacturing and maintenance costs to be high. The discharge lamp device of the ultrahigh output straight tube type shows a better luminous efficiency than the halogen lamp so as to be low in the heat generation and relatively high in the durability, but there has been still involving a problem that obtainable quantity of light has not been of a level sufficiently satisfactory. In ordinary discharge lamp devices, a current exceeding an allowable current to filament electrodes easily causes the filaments broken, so that the light output of the discharge lamp devices is subject to a restriction by the resistance to thermal fusibility of the filament electrodes and a large quantity of light is difficult to be obtained. For this reason, there has been suggested a measure for obtaining a desired quantity of light by enlarging the filament electrodes and tube diameter as well, or to employ a plurality of discharge lamps, but this causes required space for the light source inside the optical machine to be larger to render the entire machine enlarged in size and optical designing complicated.

In order to eliminate such problems as in the above, there has been suggested a discharge lamp device having no filament electrodes within the envelope, which is the so-called electrodeless discharge lamp device. Since this device has no filament electrode in the envelope, there arise no restriction by the presence of such electrode, and it becomes possible to attempt to render the device to be high in the output and minimized in size. With the electrodeless discharge lamp device in which the envelope has the fluorescent coating on the inner peripheral surfaces and such rare gas as argon or the like or such metal vapor as mercury vapor sealed therein, there have been brought about such advantages that the luminous efficiency is made excellent with a less heat generation, no deterioration arises in the quantity of light due to any blackening normally occurring at end portions of the envelope where the electrodes have been provided, and so on.

For the electrodeless discharge lamp devices of the kind referred to, there can be enumerated a device disclosed in U.S. Pat. No. 3,500,118 to J. M. Anderson, in which electrodeless discharge lamp device an ionizable metal vapor is sealed in an envelope of a closed loop shape, a ferromagnetic ferrite core is disposed with respect to a portion of the envelope for a high frequency application, and a high frequency voltage is applied through an input winding to the metal vapor inside the envelope.

While such advantages as in the above are brought about by the discharge lamp device of Anderson, there is still left such a problem when employed as the light source for reading the original document in the optical machine that the ferromagnet ferrite core disposed only to a limited portion of the closed loop envelope is likely to cause a high density plasma to be generated concentratively adjacent the limited portion of the core and only a relatively lower density plasma generated at other portions or, in other words, a uniformly high density plasma cannot be formed within the envelope so that a stable light emission will be difficult to be achieved and, when the device is employed as the light source for reading original document to be copied, no uniform light emission nor light reflection can be realized.

Field of Art:

A primary object of the present invention is, therefore, to provide an electrodeless discharge lamp device capable of being made high in the output and minimized in size, being made excellent in the luminous efficiency to lower the heat value, generating uniformly a high density plasma over the entire portions of the envelope to realize a uniform light emission over the entire envelope, and rendering the durability to be high and thus the life of use prolonged by the elimination of electrodes.

According to the present invention, the above object can be attained by providing an electrodeless discharge lamp device which comprises an envelope in which a discharge gas is sealed, and a conductive member disposed with respect to the envelope for applying a high frequency voltage to the discharge gas within the envelope, a high density plasma being generated within the envelope by the high frequency application to have light emitted, wherein the envelope is provided with at least two mutually parallel, straight tubular parts for forming a circulating discharge path.

In the electrodeless discharge lamp device according to the present invention, there are provided two straight tubular parts for forming the circulating discharge path, so that the high density plasma can be uniformly generated within the entire envelope, without being locally concentrated.

Other objects and advantages of the present invention should be made clear in following description of the invention detailed with reference to preferred embodiments of the invention shown in accompanying drawings.

BRIEF EXPLANATION OF DRAWINGS

FIG. 1 is a perspective view of the electrodeless discharge lamp device in an embodiment according to the present invention;

FIG. 2 an explanatory view for showing the relationship of the device of FIG. 1 to a part of an optical machine;

FIGS. 3 and 4 are perspective views showing other embodiments of the present invention;

FIG. 10 is a schematic explanatory view of still another embodiment of the present invention;

FIG. 11 is a diagram showing the relationship between the high frequency potential position on the conductive member and the voltage to ground in the device of FIG. 10;

FIG. 12 is a schematic explanatory view of still another embodiment of the present invention;

FIG. 13 is a diagram showing the relationship between the high frequency potiential position on the conductive member and the voltage to ground in the device of FIG. 12;

Figure 5:
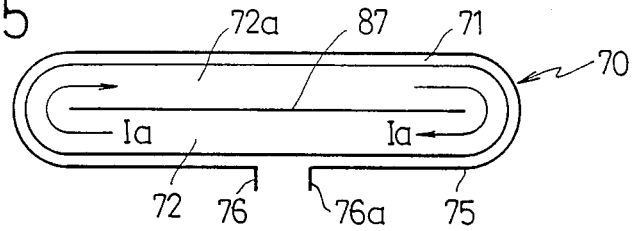
FIG. 5 is a schematic explanatory view of still another embodiment of the present invention.

While the present invention shall be now explained with reference to the respective embodiments shown in the accompanying drawings, it should be appreciated that the intention is not to limit the invention only to these embodiments shown but rather to include all modifications, alterations and equivalent arrangements possible within the scope of appended claims.

DISCLOSURE OF PREFERRED EMBODIMENTS:

Referring to FIG. 1, there is shown an electrodeless discharge lamp device 10 according to the present invention, which device 10 comprises an envelope 11 including two straight tubular parts 12 and 12*a* mutually parallel and of a cylindrical shape and a pair of hollow bridge parts 13 and 13*a* respectively coupling the both tubular parts 12 and 12*a* to each other at their portions adjacent both longitudinal ends, defining a blank space 14 in the center of the respective parts 12, 12*a* and 13, 13*a*, so that the interior of the envelope 11 will form a continuous, circulating discharge path from one of the two straight tubular parts 12 and 12*a*, through one of the hollow bridge parts 13 and 13*a* and the other of the tubular parts 12 and 12*a*, to the other of the bridge parts 13 and 13*a*. In the interior of the envelope 11, a discharging gas is sealed, and such a rare gas as argon or a mixture of the rare gas with such metal component as mercury vapor is employed as the discharging gas. On the outer periphery of the envelope 11, that is, all along the circulating discharge path, a conductive member 15 is provided and connected through power feeding terminals 16 and 16*a* to a high frequency source (not shown) so that, when a high frequency current is fed to the conductive member 15, a high frequency voltage will be applied to the discharging gas in the envelope 11 along its discharge path, due to which a plasma is generated over the entire discharge path at a high density and uniformly, an induced current Ia is thereby caused to flow throughout the discharge path, and a substantailly uniform light emission takes place in all range of the envelope 11. For the conductive member 15, a copper wire or a strip-shaped copper foil may effectively be employed.

It is preferable that the envelope 11 has a coating of a fluorescent substance on inner wall surface of the straight tubular parts 12 and 12*a*. In the present invention, specifically, the envelope 11 is doubled in the surface area by the provision of a pair of the straight tubular parts 12 and 12*a*, as compared with conventional envelope of a single straight tube, so that tube wall temperature can be remarkably made lower than in the case of the cenventional envelope and yet the fluorescent coating on the doubled wall surface area of the pair of the straight tubular part 12 and 12*a* increasingly promotes the light emission, even without increasing the feeding power. In this case, the quantum efficiency of the fluorescent substance can be prevented, by the above arrangement, from being deteriorated, and thus the arrangement can be contributive to an improvement in the durability and thus the life of use.

The electrodeless discharge lamp device according to the present invention may be employed in such optical machines as the copying machine and the like in a manner as shown concretely in FIG. 2. That is, a fluorescent substance 17 or 17*a* is applied to coat the inner wall surface of each of the straight tubular parts 12 and 12*a* of the envelope 11 while leaving longitudinal aperture portions 18 and 18*a* not coated. These apertures 18 and 18*a* are provided as defined in a mirror symmetry, so as to cause emitted light from the both tubular parts 12 and 12*a* directed diagonally upward and inward to each other and thus to be intensively incident upon a common zone FA, as convergingly reflected by reflection films 19 and 19*a* provided on the outer surface of the both tubular parts 12 and 12*a* on diameterally opposite side with respect to the apertures 18 and 18*a*.

In incorporating such discharge lamp device 10 as above into the optical machine, such as the copying machine, the device 10 is disposed, for example, within a shield casing 21 having longitudinally elongated upper and lower slits 20 and 20*a* along center line of the casing 21, an assembly of these device 10 and casing 21 is disposed between a transparent support station 22 for an original document and a light reflecting mirror 23 for directing a light from the zone FA to an optical system (not shown here). With this arrangement, light from the electrodeless discharge lamp device 10 is made incident upon an object 24 to be copied on the transparent support station 22, reflected light from the object 24 is caused to pass through the upper slit 20 of the casing 21, blank space 14 in the envelope 11 and lower slit 20*a* of the casing 21 to be incident on the mirror 23 to be conveyed to the optical system for reading contents in the object at a high precision.

In the above, the electrodeless discharge lamp device 10 emits light uniformly in the length of the both tubular parts 12 and 12*a* between the both end bridge parts 13 and 13*a*, so that the length of uniform effective light emission with respect to the entire length in the longitudinal direction of the device 10 is remarkably increased as compared with a conventional high output discharge lamp device of a single straight tube type having the filament electrodes at both longitudinal ends of the tube. In this case, the envelope 11 may be made shorter to a large extent provided that the envelope may have only substantially the same uniform light emission length as the conventional device, and consequently the optical machine in which such shortened envelope is utilized can be effectively minimized in the entire dimension of the machine, as will be readily appreciated.

Referring next to FIG. 3 showing another embodiment of the present invention, the same constituents as those in the embodiment of FIG. 1 are denoted by the same reference numerals but added by 20, in FIG. 3. In the present embodiment, a conductive member 35 is formed to be thin but wider and is provided, preferably, in close contact with the outer periphery of an envelope 31 also of a pair of straight tubular parts 32 and 32*a* coupled by both end bridge parts 33 and 33*a*. The conductive member 35 may be formed, for example, directly on the envelope 31 by means of a deposition of a heat resistive conductor film. According to this arrangement of the present instance, the conductive member 35 can function as a reflection layer as in the case of FIG. 2, so that the reflection film may not be required to be additionally provided, to render the structure simpler and inexpensive. Further, the conductive member 35 also acts as a heat radiator so as to increase the heat radiating effect, whereby the tube wall temperature of the envelope 31 can be further lowered, the coupling degree between the conductive member 35 and the gas within the envelope 31 can be increased and the luminous efficiency of the lamp device can be improved. Other arrangements and operation are the same as those in the foregoing embodiment.

In another embodiment shown in FIG. 4, an envelope 51 comprises a tube bent into U-shape having two straight tubular parts 52 and 52*a*, two open ends of which are coupled by a hollow stem 65 made preferably of a glass or ceramics, and a coolest point controller 66 is provided to a position on the side of the stem 65 which will be the coolest point upon lighting of this lamp device 50. In an event when the coolest point controller 66 is preheated by means of, for example, a heater coil wound thereon, it is possible to improve the starting stability of the device under a low temperature condition. When the coolest point controller 66 is provided with a heat radiating plate, further, it is possible to prevent the pressure of such gaseous member as mercury vapor from excessively rising inside the envelope and the light output can be prevented from being lowered. By providing to the coolest point controller 66 a member which can act as both of the heater and heat radiator, it is made possible to preheat the coolest point by feeding an electric power to the heating member upon starting the lighting but thereafter to render the member to act as the heat radiator by interrupting the power feeding thereto. With such controlling through the coolest point controller 66, the luminance of the lamp device 50 can be prevented from being made uneven due to any mercury deposit on luminous surface in the envelope 51.

In the device 50 of FIG. 4, further, the envelope 51 is shown as being a U-shaped tube, but it is of course possible to form the envelope with a pair of straight tubes and a pair of such stems as in the above and secured to both ends of the tubes, or a bridge part coupling one side ends of the tubes and a stem secured to the other side ends of the tubes, to form a circulating discharge path. In the embodiment of FIG. 4, other arrangements and operation are the same as in the embodiment of FIGS. 1 and 2, and the same constituent members as in FIGS. 1 and 2 are denoted by the same reference numerals but added by 40.

Figure 6:
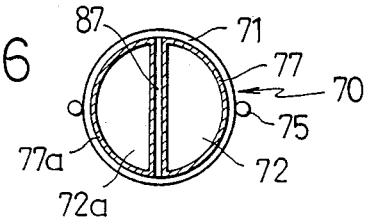
FIG. 6 is a schematic sectioned view of the device of FIG. 5.

According to another feature of the present invention, the circulating discharge path is formed, instead of employing a pair of the straight tubular parts, by dividing substantial interior space of a single envelope into two parts. Referring now to FIGS. 5 and 6 showing another embodiment, a discharge lamp device 70 comprises a tubular envelope 71, in which a partition 87 is provided to extend along longitudinal axial line of the envelope 71, except both end portions thereof and across diametrally opposing wall portions to be secured thereto, so that a circulating discharge path including a pair of straight parts 72 and 72*a* will be defined inside the single envelope 71, the path being surrounded by a conductive wire member 75. Other arrangements and operation of this embodiment of FIGS. 5 and 6 are the same as in the embodiment of FIGS. 1 and 2, and the same constituents as in the FIGS. 1 and 2 embodiment are denoted by the same reference numerals but added by 60.

Figure 7:
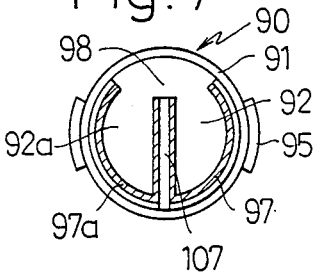
FIG. 7 shows in a sectioned view a further embodiment of the present invention.

FIG. 7 is of another embodiment according to the said another feature of the present invention, in which an envelope 91 encloses a partition 107 leaving such both end portions as in FIG. 5 and one side portion of the diametrally opposing longitudinal portions of the tubular envelope 91 open, as separated from inner wall surface of the envelope, and the fluorescent coating at 97 and 97*a* is omitted at the portions from which the partition 107 is separated, whereby an aperture 98 is formed in the device 90 so that an optimum discharge lamp device for use in the optical machines, as has been referred to with reference to FIG. 2. Including the use of a wider strip-shaped conductive member 95 in the embodiment of FIG. 7, other arrangements and operation are the same as in the foregoing embodiments, and the same constituents as in the embodiment of FIGS. 1 and 2 are denoted by the same reference numerals but added by 80.

Figure 8:
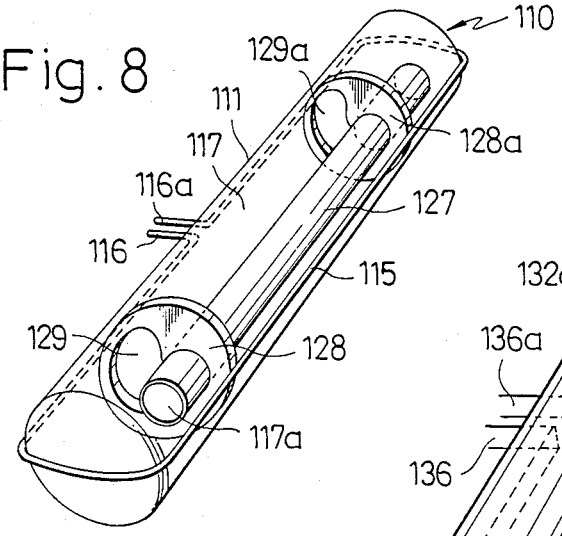
FIGS. 8 and 9 show in perspective views still further embodiments of the present invention.

FIG. 8 shows still another embodiment according to the said another feature of the present invention, in which an envelope 111 is tubular and encloses therein an inner tube 127 opened at both ends and disposed in parallel to longitudinal axis of the envelope 111 as passed through a pair of supporting disks 128 and 128*a* longitudinally in the envelope. Through holes 129 and 129*a* are made in these supporting disks 128 and 128*a*, so that a circulating discharge path including two straight parts 117 and 117*a* will be formed also in the present embodiment, as will be readily appreciated. Other arrangements and operation of this FIG. 8 embodiment are the same as in the embodiment of FIGS. 1 and 2 and the same constituents are denoted by the same reference numerals but added by 100. In the present instance, the inner tube 127 is shown to be single here, whereas its number should be increased as required.

Figure 9:
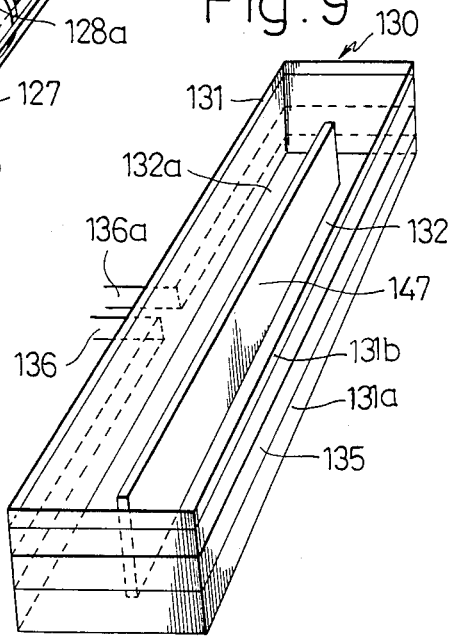

In FIG. 9, a still further embodiment according to the said another feature of the invention is shown, in which an envelope 131 is formed in a rectangular shape and comprises a box-shaped body 131*a* opened on one longitudinal side, and a transparent glass plate cover 131*b* fitting to and adhered to the opened side of the body 131*a* by a frit or the like. Inside this envelope 131, a partition 147 shorter than the length of the envelope 131 is provided as centrally erected and a circulating discharge path including two straight parts 132 and 132*a* is thereby defined. Including the use of a wider strip-shaped conductive member 135 surrounding the envelope 131, other arrangements and operation of this embodiment of FIG. 9 are the same as those in the embodiment of FIGS. 1 and 2, and the same constituents are denoted by the same reference numerals but added by 120. Further, the box-shaped body 131*a* of the envelope 131 may be formed in any other shape, such as a semicylindrical shape having a curved surface in section.

According to still another feature of the present invention, there is provided an arrangement in which any potential difference between both power feeding terminals of the conductive member and between the conductive member and the ground is minimized, so that the high frequency voltage will be applied through the conductive member reliably uniformly along the circulating discharge path. Referring now to FIG. 10, an electrodeless discharge lamp device 150 comprises an envelope 151 peripherally provided with a conductive member 155 which has interruptions at four positions, so that the conductive member 155 will have eight cut ends A-H while adjacent pairs of such cut ends are electrically connected through each of capacitors 170*a*–170*d* to connect all interrupted portions of the member 155 in series with each other. While one 170*a* of these capacitors is connected in parallel to a power source S in the same manner as in known devices, remaining three capacitors 170*b*–170*d* are connected in series to the source S. In this case, the respective interruptions function as four inductors and the capacitors 170*a*–170*d* are to be connected in series with each other through these inductors. These capacitors 170*a*–170*d* are so set in the capacity as to substantially resonate to an operating frequency in cooperation with the inductors at the interruptions, and are thus capable of functioning as a high frequency matching circuit. For the capacitors, the one of variable capacity may similarly employed.

Generally, in this conductive member 155, there exists a substantially uniform potential gradient in the longitudinal direction of the member, so that the potential difference between the cut ends G and H will be normally about $\frac{1}{4}$ of that between other ends A and H to be advance in phase by 90 degrees with respect to the induction, i.e., the electric current. In the present instance, the arrangement of the capacitors and inductors formed by the interruptions for their resonance will be effective to render a voltage occurring at, for example, the capacitor 170*d* inserted between the cut ends F and G to be capacitive but a voltage between the cut ends G and H to be inductive, and these voltages are mutually in opposite phase, so as to be cancelled with each other. In contrast to the known arrangement of single capacitor connected in parallel to the power source for energizing a single piece conductive member, therefore, as shown in FIG. 11, the largest value of the voltage across the terminals of the conductive member and its voltage to ground in the present embodiment of FIG. 10 will be reduced to be about $\frac{1}{4}$, as shown by solid lines PI, of that shown by a solid line PR of the known arrangement.

In this way, the largest potential can be gradually reduced by the multiple-division of the conductive member 155, the application of the high frequency voltage to the discharge gas in the envelope 151 can be thereby made uniform, a high density plasma is generated more uniformly to realize a uniform light emission over the entire length of the envelope, and any blackening of the interior wall surface in the envelope 151 can be also restrained. In the present instance, the largest value of the voltage across the terminals and voltage to ground can be more reduced by a larger number of the division of the conductive member 155, but an excessively smaller potential difference will be likely to deteriorate the startability of the lamp device, and it is preferable, for example, to have part of the cut ends disposed at a longitudinal end or ends of the envelope so as to render the potential difference not excessively smaller. In the embodiment of FIG. 10, other arrangements and operation are the same as in the foregoing embodiment of FIGS. 1 and 2 and the same constituents as those in the FIG. 1 embodiment are denoted by the same reference numerals but added by 140.

Referring next to FIG. 12, there is shown a further embodiment for reducing the potential difference between the power feeding terminals of the conductive member and between the conductive member and the ground. In the present instance, there is provided an electrostatic shield 201 extending preferably over circumferentially one half of an envelope 181 with power feeding terminals 186 and 186*a* of the conductive member 185 disposed in the center. This electrostatic shield 201 is electrically insulated from the conductive member 185 and is connected to a junction point between a pair of capacitors 200*a* and 200*b*, to be in parallel to the power source S, and therethrough to the ground. The shield 201 itself may be formed by the same copper foil as the conductive member 185, or in the form of a conductor layer provided by means of a deposition or the like on the outer periphery of the envelope 181.

According to this embodiment, the shield potential on the electrostatic shield 201 will be as shown by broken lines in FIG. 13, upon which the shield 201 performs the shielding action in the electrostatic sense, but an electromotive force due to the electromagnetic induction is generated thereover, and their potential gradients become parallel to each other. In this case, an electric field electrostatically provided in the envelope is to rely, at the portion where the shield 201 is present, on the shield potential of the shield 201 but, at other portion, on the conductive member 185. Accordingly, the largest value of the potential to ground will be at positions C and F and will be $\frac{1}{4}$, as shown by a solid line PI in FIG. 13, of that in the known arrangement shown by a solid line PR also in FIG. 13 (substantially the same as that referred to with reference to FIG. 11). The potential difference between mutually adjacent positions B and C as well as F and G will be about $\frac{1}{2}$ of that in the known arrangement, so that the potential difference between the both power feeding terminals of the conductive member as well as between the conductive member and the ground can be reduced to a large extent. In the present embodiment of FIG. 12, other arrangements and operation are the same as those in the embodiment of FIGS. 1 and 2 and the same constituents are denoted by the same reference numerals but added by 170.

Figure 14:
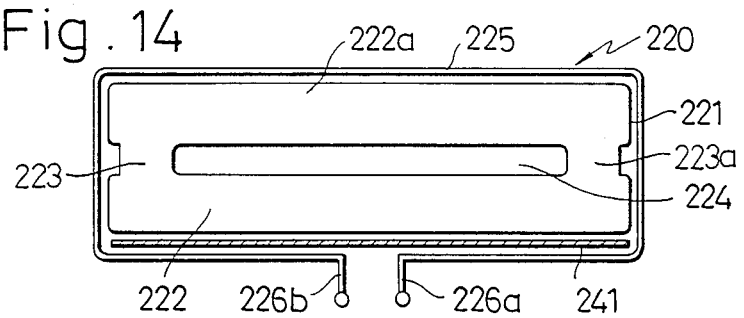
FIGS. 14 and 15 are schematic explanatory views of the device of the present invention in further embodiments in which an electrostatic shielding is incorporated.
Figure 15:
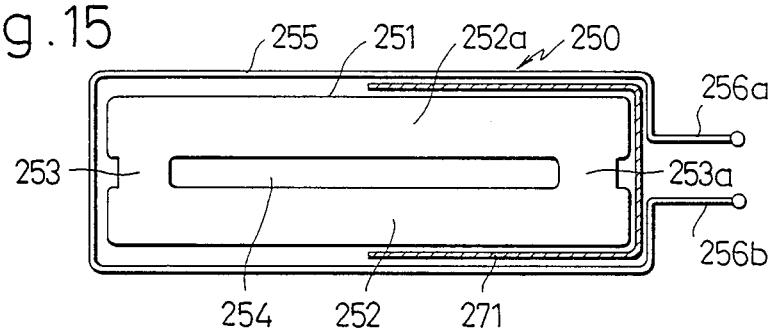

As shown in FIG. 14, on the other hand, substantially equal operation and effect to those of FIG. 12 can be attained by providing an electrostatic shield 241 which is not extended over to both end bridge parts 223 and 223*a* but only along a straight part 222 of an envelope 221, the straight part 222 being on the side where both power feeding terminals 226*a* and 226*b* of a conductive member 225 surrounding the envelope are present. When, as shown in FIG. 15, the power feeding terminals 256*a* and 256*b* of a conductive member 255 are disposed on one bridge part 253*a* on a longitudinal end of an envelope 250, it is preferable that the electrostatic shield 271 is provided to dispose its central part also on the side of the bridge part 253*a* to extend therefrom halfway along both straight parts 252 and 252*a* of the envelope, so that the operation and effect substantially equal to those in the embodiment of FIG. 12 can be attained. Other arrangements and operation in these embodiments of FIGS. 14 and 15, including the unified light emission and blackening prevention, are the same as those in the foregoing embodiments, and the same constituents as in the embodiment of FIGS. 1 and 2 are denoted by the same reference numerals but added by 210 and 240 respectively in FIGS. 14 and 15.

Figure 16:
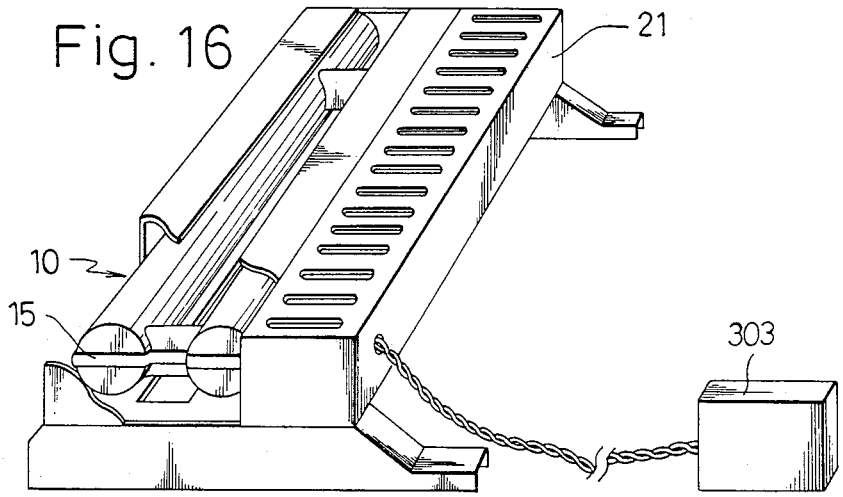
FIG. 16 shows in a perspective view an example of employing the device of the present invention as a light source for reading original document to be copied.
Figure 17:
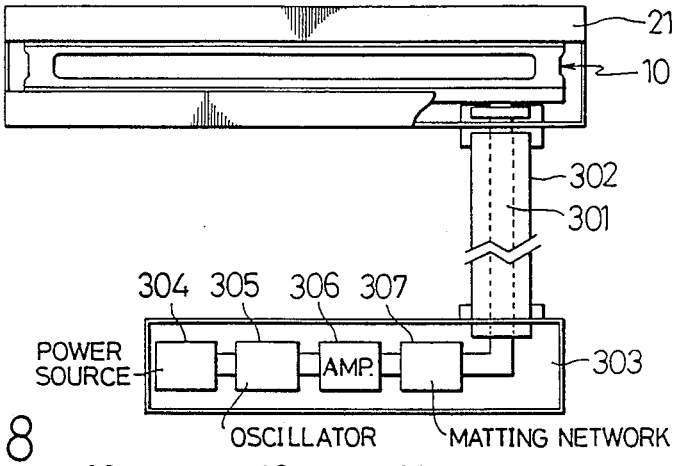
FIG. 17 is a plan view of the example shown in FIG. 16.
Figure 18:
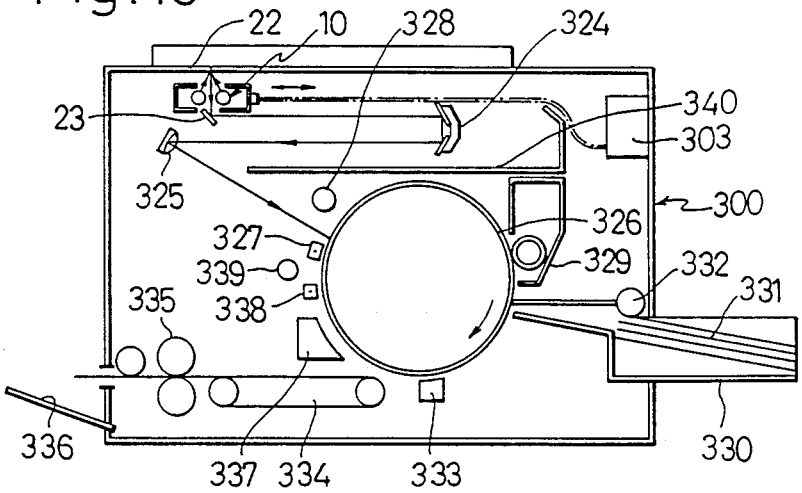
FIG. 18 is a schematic explanatory view of the interior of a copying machine in which the device according to the present invention is employed.

Further, a practical example of an application of the electrodeless discharge lamp device according to the present invention to a copying machine as an optical machine shall now be referred to in details. Referring to FIGS. 16 and 18, the discharge lamp device 10 is mounted in such shield case 21 as in FIG. 2 preferably made on an aluminum material, and is connected through a cable 302 which is, preferably as shown in FIG. 17, flat, flexible and including a high frequency output line 301 to a circuit section 303 which includes a power source 304 to which connected through an oscillator 305 is an amplifier 306. If required, the circuit section 303 is made to include a high frequency matching network 307 comprising resonant capacitor, inductance, resistor and so on so that, upon connection of the source 304, a high frequency voltage will be applied from the circuit section 303 to the conductive member 15 in the device 10 and the latter will be lighted. Here, the cable 302 normally includes various control lines, signal lines of a light quantity sensor for feedback dimming control or the like, so that the device will be provided with effective functions to be an intended light source for reading the original document or the like object.

Further, in order to reduce any leakage noise from the device 10, the shield casing 21 should preferably be covered by a cover of a conductive material, except for regions adjacent the upper and lower slits 20 and 20*a*. If required, in this case, a mesh designed to be effective to reduce the noise while maintaining the light transmission property may be provided in the slits 20 and 20*a*.

The electrodeless discharge lamp device 10 of the above arrangement is disposed in a copying machine 300 to be below the object supporting station 22, preferably in a shiftable manner. When the object 24 to be copied is placed on the station 22 and the device 10 is actuated to scanningly read the object, light emitted from the device 10 and reflected by the object is to be incident through the first mirror 23 and second mirror 324 on an in-mirror lens 325 and, as thereby reflected, projects an optical image which has been read from the object on a sensitive drum 326 electrified by an electrifier 327, so that an electrostatic latent image will be formed with respect to the optical image on the sensitive drum 326 by subjecting the optical image to an exposure by means of an exposure lamp 328, and this electrostatic latent image will be visualized by means of an image displaying agent or the like at a developing station 329.

A copying paper 331 is conveyed from a paper feed tray 330 through a pick-up roller 332 onto the sensitive drum 326, the visualized image on the drum 326 is transferred to the paper 331 through a transferring electrifier 333, the paper is then placed on a conveyor 334, on which the image transferred to the paper 331 is subjected to a fixation at a fixing means 335, and the paper 331 is placed on a discharge tray 336. Any image displaying agent left sticking on the drum 326 from which the image has already been transferred will be cleaned off by a cleaner 338, and the drum surface is effectively antistatically treated through a static eliminator 338 and antistatic lamp 339 so as to be ready to a next image transfer cycle. Between the discharge lamp device 10 and the sensitive drum 326, a shield plate 340 is installed for prevention of any noise radiation.

It should be readily appreciated by any one skilled in the art that, when the electrodeless discharge lamp device 10 according to the present invention is utilized in such optical machine as the copying machine 300, the device 10 is highly suitable for being used as the light source for reading the original image as the device is high in the luminous efficiency and output with a uniform light emission realized so that an optimum copying operation can be performed, and the device 10 made electrodeless is highly durable with an easy maintenance required and minimized in size, so that the device can be contributive also to a minimization of the entire optical machine.

What we claim as our invention is:

1. An electrodeless discharge lamp device comprising an envelope including at least two mutually parallel and straight tubular parts forming a circulating discharge path, a discharge gas sealed in said envelope, and a conductive member provided on the outer periphery of said envelope to closely extend all along said circulating discharge path of said envelope for applying a high frequency voltage to said discharge gas in the envelope to cause a uniform light emission carried out over the entire range of the envelope.

2. A device according to claim 1, wherein said straight tubular parts of said envelope comprise cylindrical tubes which are coupled to each other at their portions adjacent both ends through a discharge path coupling means.

3. A device according to claim 2, wherein said discharge path coupling means comprises a hollow bridge parts.

4. A device according to claim 1, wherein said conductive member comprises a copper wire.

5. A device according to claim 1, wherein said conductive member comprises a copper foil of a wider strip shape.

6. A device according to claim 5, wherein said copper foil forming said conductive member is provided by means of a deposition on outer surface of said envelope.

7. A device according to claim 1, wherein said envelope is of monolithic structure, and said two straight parts are defined by a partition provided inside the envelope.

8. A device according to claim 7, wherein said envelope comprises a cylindrical pipe, and said partition expands diametrally in the envelope.

9. A device according to claim 7, wherein said envelope comprises a cylindrical pipe, and said partition comprises an inner cylindrical pipe.

10. A device according to claim 7, wherein said envelope is of a box shape, and said partition extends in longitudinal direction of the envelope.

11. A device according to claim 1, wherein said conductive member is cut at a plurality of locations along the entire periphery of said envelope to provide a plurality of pairs of cut ends, one of said pairs of cut ends being employed as power feeding terminals and other pairs of cut ends being connected to each other through a capacitor.

12. A device according to claim 1, which further comprises an electrostatic shield member extending along at least one of said two straight tubular parts with power feeding terminals of said conductive member as the center, as disposed between said envelope and the conductive member and insulated from the conductive member.

13. A device according to claim 1, which further comprises a high frequency matching circuit connected to said conductive member and including resonating capacitors, said high frequency matching circuit being disposed adjacent said envelope.

14. A device according to claim 13, wherein said high frequency matching circuit comprises variable capacitors.

15. An electrodeless discharge lamp device unit comprising an electrodeless discharge lamp device which comprises an envelope including at least two mutually parallel and straight tubular parts forming a circulating discharge path, a discharge gas sealed in said envelope, and a conductive member provided on the outer periphery of said envelope to closely extend all along said circulating discharge path of said envelope for applying a high frequency voltage to said discharge gas in the envelope to cause a uniform light emission carried out over the entire range of the envelope; and a circuit section connected to said conductive member and supplying thereto a high frequency power.

16. A device according to claim 15, which further comprises means for connecting between said electrodeless discharge lamp device and said circuit section.

17. A device according to claim 16, wherein said connecting means is a flexible cable including a high frequency output line.

18. A device according to claim 15, wherein said circuit section is adjacently disposed and separate from said conductive member.

* * * * *